US008827496B2

(12) United States Patent
VanderSchuit

(10) Patent No.: US 8,827,496 B2
(45) Date of Patent: Sep. 9, 2014

(54) ILLUMINATION APPARATUS

(76) Inventor: Carl R. VanderSchuit, San Diego, CA (US)

( * ) Notice: Subject to any disclaimer, the term of this patent is extended or adjusted under 35 U.S.C. 154(b) by 63 days.

(21) Appl. No.: 13/348,123

(22) Filed: Jan. 11, 2012

(65) Prior Publication Data

US 2012/0176782 A1 Jul. 12, 2012

Related U.S. Application Data

(60) Provisional application No. 61/431,816, filed on Jan. 11, 2011.

(51) Int. Cl.
*F21L 4/02* (2006.01)
*F21S 10/00* (2006.01)

(52) U.S. Cl.
CPC ..... *F21S 10/007* (2013.01); *F21S 10/00* (2013.01); *Y10S 362/806* (2013.01)
USPC ..... 362/277; 362/281; 362/283; 362/284; 362/806; 362/184

(58) Field of Classification Search
CPC ..... F21S 10/00; F21S 10/007
USPC ..... 362/184, 283, 806, 284, 281, 277
See application file for complete search history.

(56) References Cited

U.S. PATENT DOCUMENTS

| | | | |
|---|---|---|---|
| 1,107,645 | A | 8/1914 | Benedict |
| 1,923,522 | A | 8/1933 | Whitehouse |
| 2,152,467 | A | 3/1939 | Crosby |
| 2,765,481 | A | 10/1956 | Manhart et al. |
| 3,099,565 | A | 7/1963 | Neuhauser |
| 3,559,224 | A | 2/1971 | Shimizu |
| 3,580,575 | A | 5/1971 | Speeth |
| 3,735,113 | A | 5/1973 | Stott |
| 3,793,755 | A | 2/1974 | Gersch et al. |
| D231,252 | S | 4/1974 | Feldman |
| 3,818,208 | A | 6/1974 | Kahl |
| 4,034,231 | A | 7/1977 | Conn et al. |
| 4,109,405 | A | 8/1978 | Ito |
| 4,124,881 | A | 11/1978 | Haber |
| 4,181,304 | A | 1/1980 | Haber |
| 4,183,316 | A | 1/1980 | Bennett |
| 4,237,525 | A | 12/1980 | Deter |
| 4,309,743 | A | 1/1982 | Martin |

(Continued)

FOREIGN PATENT DOCUMENTS

| | | |
|---|---|---|
| CH | 662931 | 11/1987 |
| DE | 29918185 | 2/2000 |

(Continued)

*Primary Examiner* — Stephen F Husar
*Assistant Examiner* — James Cranson, Jr.
(74) *Attorney, Agent, or Firm* — Lewis Kohn & Fitzwilliam LLP; Kent M. Walker; Kari Moyer-Henry

(57) ABSTRACT

An illumination apparatus that includes a housing assembly made up of a housing, seat and top with optional attachment. A light source, power source, switch and controller are further included with the assembly. A light-altering device is also included in or proximate to the housing. The light source emits light through a light-altering surface. An optional motor is included to move the light alternating surface or light source, such as about a central axis. The switch and controller connected are programmable to control and vary the light source and motor among preselected and selectable patterns.

9 Claims, 13 Drawing Sheets

(56) References Cited

U.S. PATENT DOCUMENTS

| | | | | |
|---|---|---|---|---|
| 4,325,230 | A | 4/1982 | Driscoll | |
| 4,331,848 | A | 5/1982 | Schneider, Jr. | |
| 4,341,087 | A | 7/1982 | Steenburgh | |
| 4,390,928 | A | 6/1983 | Runge | |
| 4,409,644 | A | 10/1983 | Axton et al. | |
| D272,128 | S | 1/1984 | Parmentier | |
| D272,232 | S | 1/1984 | Parmentier | |
| 4,464,131 | A | 8/1984 | Plante et al. | |
| 4,545,479 | A | 10/1985 | Figari | |
| 4,553,194 | A | 11/1985 | Bailey | |
| 4,554,189 | A | 11/1985 | Marshall | |
| 4,556,932 | A | 12/1985 | Lehrer | |
| 4,600,974 | A | 7/1986 | Lew et al. | |
| 4,605,882 | A | 8/1986 | DeLuca | |
| 4,638,409 | A | 1/1987 | Berman | |
| 4,641,840 | A | 2/1987 | Larson | |
| 4,719,544 | A | 1/1988 | Smith | |
| 4,733,785 | A | 3/1988 | Turner, Jr. et al. | |
| 4,761,314 | A | 8/1988 | Marshall | |
| 4,796,167 | A | 1/1989 | Brown et al. | |
| 4,827,655 | A | 5/1989 | Reed | |
| 5,018,053 | A | 5/1991 | Belknap | |
| 5,027,258 | A | 6/1991 | Schoniger et al. | |
| 5,054,778 | A | 10/1991 | Maleyko | |
| 5,070,435 | A | 12/1991 | Weller | |
| 5,070,437 | A | 12/1991 | Roberts, Sr. | |
| 5,119,279 | A | 6/1992 | Makowsky | |
| 5,143,439 | A | 9/1992 | Lewis | |
| 5,165,781 | A | 11/1992 | Orak | |
| 5,201,578 | A | 4/1993 | Westmoland | |
| 5,211,699 | A | 5/1993 | Tipton | |
| 5,231,781 | A | 8/1993 | Dunbar | |
| 5,253,149 | A | 10/1993 | Ostema | |
| 5,276,599 | A | 1/1994 | Neeley | |
| 5,295,882 | A | 3/1994 | McDermott | |
| 5,323,300 | A | 6/1994 | McCrary | |
| 5,438,488 | A | 8/1995 | Dion | |
| 5,463,537 | A | 10/1995 | Trattner et al. | |
| D365,911 | S | 1/1996 | Cassetti et al. | |
| 5,497,307 | A | 3/1996 | Bae | |
| 5,516,317 | A | 5/1996 | Moody | |
| 5,567,037 | A | 10/1996 | Ferber | |
| 5,575,533 | A | 11/1996 | Glance | |
| 5,575,553 | A | 11/1996 | Tipton | |
| 5,603,219 | A | 2/1997 | Kolb | |
| 5,609,411 | A | 3/1997 | Wang | |
| 5,622,422 | A | 4/1997 | Rodgers | |
| 5,624,177 | A | 4/1997 | Rosaia | |
| 5,632,548 | A | 5/1997 | Mayfarth | |
| 5,636,770 | A | 6/1997 | Hachinohe et al. | |
| 5,649,758 | A | 7/1997 | Dion | |
| 5,653,524 | A | 8/1997 | Gray | |
| 5,685,097 | A * | 11/1997 | Marinov | 40/431 |
| 5,697,182 | A | 12/1997 | Rodgers | |
| 5,743,620 | A | 4/1998 | Rojas | |
| 5,763,845 | A | 6/1998 | Hsieh | |
| 5,775,800 | A | 7/1998 | Hsieh | |
| 5,784,265 | A | 7/1998 | Chen | |
| 5,785,407 | A | 7/1998 | Ratchiffe | |
| 5,860,724 | A | 1/1999 | Cheng | |
| 5,876,109 | A | 3/1999 | Scalco | |
| 5,879,068 | A | 3/1999 | Menashrov | |
| 5,903,212 | A | 5/1999 | Rodgers | |
| 5,934,519 | A | 8/1999 | Kim et al. | |
| 5,934,784 | A | 8/1999 | Dion | |
| 5,971,827 | A | 10/1999 | Lee et al. | |
| D425,706 | S | 5/2000 | Calderone | |
| 6,106,130 | A | 8/2000 | Harding | |
| 6,106,132 | A | 8/2000 | Chen | |
| 6,116,753 | A | 9/2000 | Tsang | |
| 6,135,604 | A | 10/2000 | Lin | |
| 6,155,700 | A | 12/2000 | Hsu | |
| 6,254,247 | B1 | 7/2001 | Carson | |
| 6,277,079 | B1 | 8/2001 | Avicola et al. | |
| 6,286,974 | B1 | 9/2001 | Rochel et al. | |
| 6,296,376 | B1 | 10/2001 | Kondo et al. | |
| 6,344,252 | B1 | 2/2002 | Werner | |
| 6,352,352 | B1 | 3/2002 | Schletterer et al. | |
| 6,354,460 | B1 | 3/2002 | Cornell et al. | |
| 6,354,711 | B1 | 3/2002 | McCoy | |
| 6,375,092 | B1 | 4/2002 | Banach | |
| 6,416,198 | B1 | 7/2002 | VanderSchuit | |
| 6,481,148 | B1 | 11/2002 | Lindgren | |
| 6,584,713 | B2 | 7/2003 | Huang | |
| 6,666,569 | B2 | 12/2003 | Obata | |
| 6,824,289 | B2 | 11/2004 | VanderSchuit | |
| 6,874,909 | B2 * | 4/2005 | Vanderschuit | 362/232 |
| 6,935,761 | B2 | 8/2005 | VanderSchuit | |
| 6,955,450 | B2 | 10/2005 | Johnson | |
| 6,966,666 | B2 | 11/2005 | Liu | |
| 7,003,906 | B1 * | 2/2006 | Yang | 40/430 |
| 7,052,154 | B2 | 5/2006 | VanderSchuit | |
| 7,052,167 | B2 | 5/2006 | VanderSchuit | |
| 7,063,432 | B2 | 6/2006 | VanderSchuit | |
| 7,073,917 | B2 | 7/2006 | VanderSchuit | |
| 7,077,553 | B2 | 7/2006 | VanderSchuit | |
| D547,899 | S | 7/2007 | VanderSchuit | |
| D550,393 | S | 9/2007 | VanderSchuit | |
| D550,394 | S | 9/2007 | VanderSchuit | |
| D550,395 | S | 9/2007 | VanderSchuit | |
| D550,396 | S | 9/2007 | VanderSchuit | |
| D558,387 | S | 12/2007 | VanderSchuit | |
| 7,311,411 | B2 | 12/2007 | VanderSchuit | |
| 2002/0105808 | A1 * | 8/2002 | Ting Yup | 362/281 |
| 2003/0090892 | A1 | 5/2003 | Su | |
| 2003/0161144 | A1 | 8/2003 | McKinney | |
| 2004/0130886 | A1 | 7/2004 | Lewis et al. | |
| 2004/0264187 | A1 | 12/2004 | VanderSchuit | |
| 2005/0180146 | A1 | 8/2005 | VanderSchuit | |

FOREIGN PATENT DOCUMENTS

| | | |
|---|---|---|
| EP | 231471 | 2/1986 |
| EP | 1313986 | 5/2003 |
| GB | 2381575 | 5/2003 |
| GB | 2392973 | 3/2004 |
| JP | 06-267327 | 9/1994 |
| JP | 07-289405 | 11/1995 |
| JP | 2003-137014 | 5/2003 |
| JP | 2003259951 | 9/2003 |
| JP | 2004-105231 | 4/2004 |
| WO | 93-18358 | 2/1993 |
| WO | 0210642 | 2/2002 |
| WO | 2004005796 | 1/2004 |

* cited by examiner

ILLUMINATION APPARATUS

The present application claims the benefit and priority of and incorporates by this reference U.S. Provisional Application No. 61/431,816 filed with the United States Patent and Trademark Office on Jan. 11, 2011.

FIELD OF THE INVENTION

The present invention relates generally to light sources and more particularly to illumination apparatus that provide atmospheric-enhancing illumination, such as visually pleasing light effects and patterns.

BACKGROUND OF THE INVENTION

The statements in this section merely provide background information related to the present disclosure and may not constitute prior art.

Illumination devices have been used for many years to provide atmospheric-enhancing illumination or mood lighting. There still exists a continuing demand and need for illumination devices that provide visually-pleasing illumination effects and light patterns.

In addition, containers, apparel and other accessory items are being provided with light sources, such as light-emitting diodes, that draw attention to the accessory item and its user. However, the inventor has recognized that these light sources are typically positioned to emit light outwardly from the accessory item without illuminating the accessory item itself or without projecting light through accessory item itself for lighting effects, which would provide a more stimulating and pleasing visual effect.

SUMMARY OF THE INVENTION

In order to solve these and other needs in the art, the inventor hereof has succeeded in designing an illumination apparatus that in one exemplary embodiment includes a housing assembly made up of a housing, seat and top with optional attachment. A light source, power source, switch and controller are further included with the assembly. A light-altering device is also included in or proximate to the housing. For example, the light-altering device may comprise film-like material (e.g., acetate, etc.) having patterns and background of varying translucence and transparency. That material is positioned adjacent the side wall so that light emitted from the light source project various light patterns based on the light-altering material. This light-altering material may also comprise the side wall itself or etching, facets or other patterns or objects which can alter the light of the light source. In operation, the light emitted from the apparatus passes through the light-altering device and side walls of the housing, which have varying translucence and transparency properties, to provide various lighting effects.

The housing itself defines a chamber and includes side walls with light-altering surfaces. The seat defines a space for positioning the light source. The light source is positioned such that it illuminates at least a part of the chamber of the housing, its side walls, light-altering devices and surfaces supporting the illumination apparatus. The seat also fits to the upper portion of the housing to allow rotational movement relative to the housing. This allows alteration of the position of the light source and the direction of the light emission relative to the housing.

The top is fitted to the seat, so that the light source, as well as a power source, switch and controller, are positioned between the top and seat. The top and seat are also fitted together to allow rotational movement relative to each other as well as lateral movement sufficient to activate the switch. The light source, as controlled by the switch and controller, may be configured to provide various lighting combinations of light colors and duration. These features allow further variable light effects emitted by the apparatus.

The invention may also include an attachment to the housing assembly via the top. In a preferred embodiment, the attachment includes a beverage receptacle, such as one resembling a shot glass, which includes light-altering devices and surfaces and rotates relative to the seat and/or housing. As such, the attachment adds additional shapes, surfaces and movements for providing additional lighting effects.

Further areas of applicability of the present invention will become apparent from the detailed description provided hereinafter. It should be understood that the detailed description and specific examples below, while indicating exemplary embodiments of the invention, are intended for purposes of illustration only and are not intended to limit the scope of the invention.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
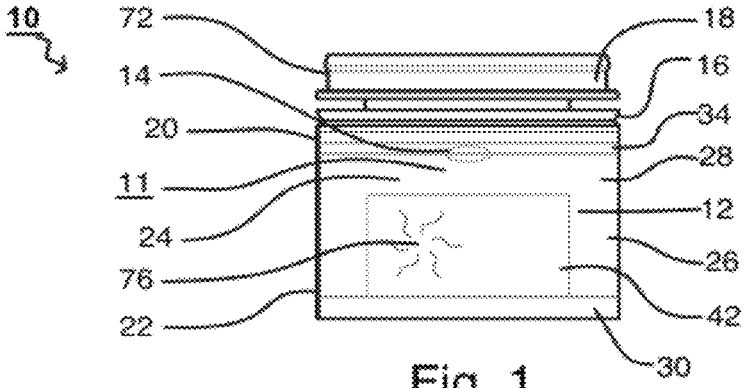
FIG. 1 is a side view of an illumination apparatus according to one embodiment of the present invention.

The following description of various embodiments is merely exemplary in nature and is in no way intended to limit the invention, its applications, or uses. Throughout the drawings, corresponding reference numerals indicate like or corresponding parts and features.

Referring to FIG. 1, there is shown an illumination apparatus, generally indicated by reference number 10, according to one embodiment of the present invention. As shown in FIG. 1, the illumination apparatus 10 includes a housing 12, a seat 16, a top 18, at least one light source 14. Together, the housing 12, seat 16 and top 18 form a multi-piece or single-piece housing assembly 11.

Figure 2:
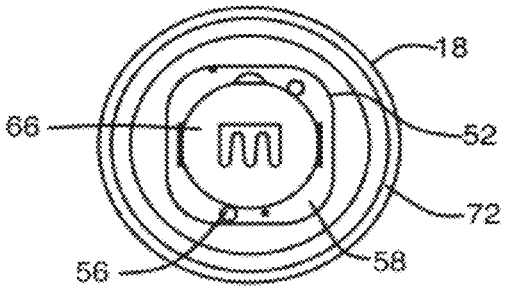
FIG. 2 is a top view of the illumination apparatus shown in FIG. 1.
Figure 3:
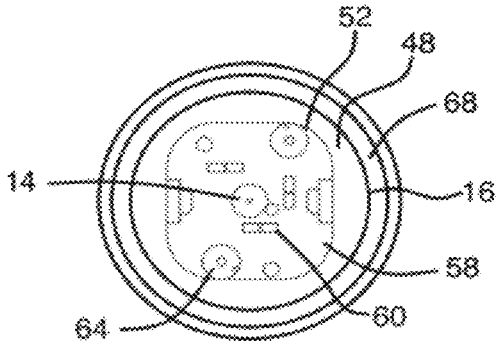
FIG. 3 is a bottom view of the illumination apparatus shown in FIG. 1.

In the exemplary embodiment shown in FIGS. 1 through 3, the housing 12 and housing assembly 11 are substantially cylinder-shaped. It is to be understood, however, that any component described herein (e.g., the housing 12 and housing assembly 11, including the corresponding top and seat components 18 and 16) may comprise any of a wide range of other shapes including, but not limited to, squares, rectangles, triangles, parallelograms, diamonds, semicircles, octagonal, hexagonal, ovular, u-shaped, c-shaped, names, logos, other alphanumeric characters or any other multidimensional object, including geographic landmarks/features, buildings/other manmade structures, cars, animals or other shapes. Accordingly, embodiments of the invention should not be limited to only circular or rectangular shaped housings and attachments.

It is to be further understood, that any component described herein (e.g., the housing 12 and housing assembly 11, including the corresponding top and seat components 18 and 16) may vary in dimension and design to that shown and described in relation to the figures. One of skill in the art will appreciate that any of the components may have, as compared to what is shown and described in relation to the figures, different lengths, heights, widths, volumes, circumferences, diameters, angles, or other geometric dimensions.

A wide range of materials may be used for the housing assembly 11, including, but not limited to, acrylics, glasses, plastics, among others. The surfaces of the housing assembly 11 may be transparent, translucent, opaque, reflective, or a combination thereof.

With respect to the structure of the housing 12, seat 16, and top 18 themselves, this is shown for the exemplary embodiment in FIGS. 1 through 3 (housing assembly 11), the exploded view in FIG. 4, and FIGS. 5-7 (top 18), 11-13 (housing 12) and 14-16 (seat 16). As shown, the housing 12 is comprised of an upper portion 20 and a lower portion 22. The lower portion 22 defines a chamber 24 and includes at least one side wall 26 including at least one light-altering surface 28. In this embodiment, the side wall 26 comprises a cylindrical wall surrounding the chamber 24. The housing 12 further includes a housing lower surface 30 at the lower portion 22, on which the housing 12 can rest positioned against or opposite a support surface 114. The upper portion 20 of the housing 12 defines an opening 32 for the seat 16. The upper portion 20 also includes a fitting, shown in FIGS. 1 and 11 as a ring-like ridge 34 extending into and around the side wall 26 inner surface of the upper portion 20.

Figure 4:
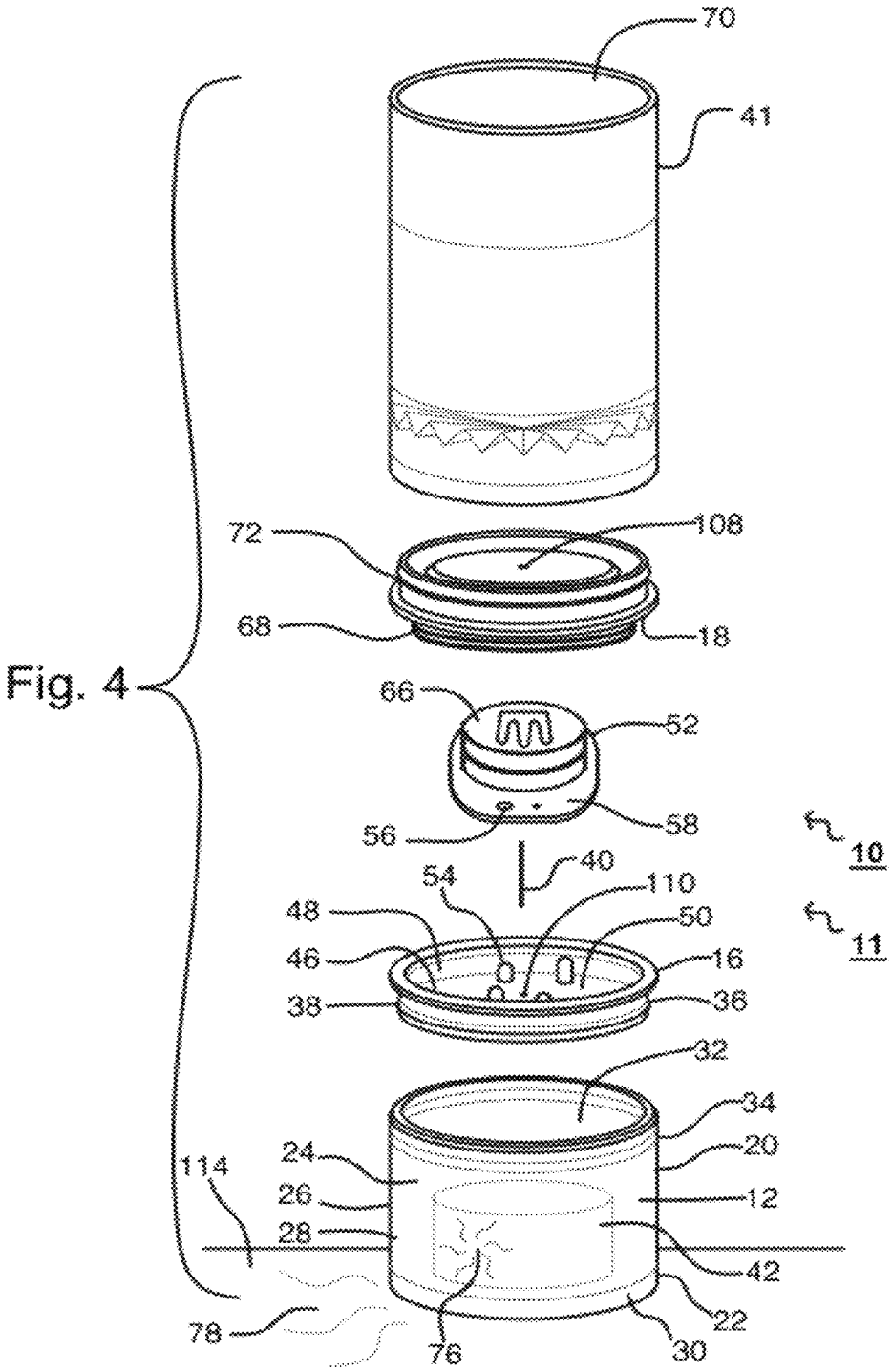
FIG. 4 is a perspective, exploded view of the illumination apparatus shown in FIG. 1 and the attachment shown in FIG. 17.
Figure 5:
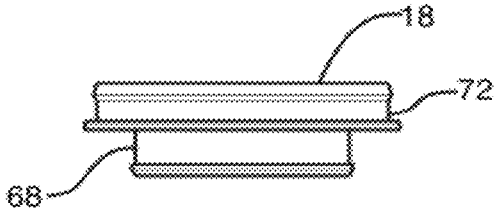
FIG. 5 is a side view of the top of FIG. 4.
Figure 6:
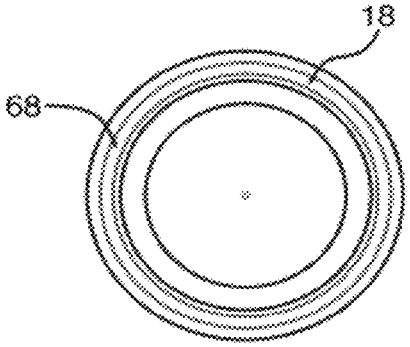
FIG. 6 is a top view of the top of FIG. 4.
Figure 7:
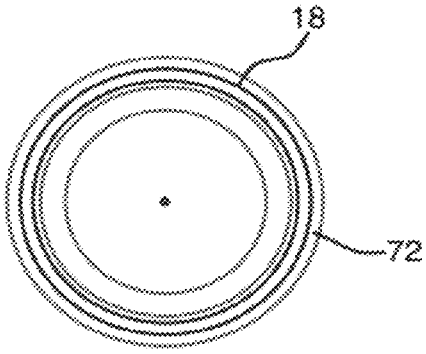
FIG. 7 is a bottom view of the top of FIG. 4.
Figure 13:
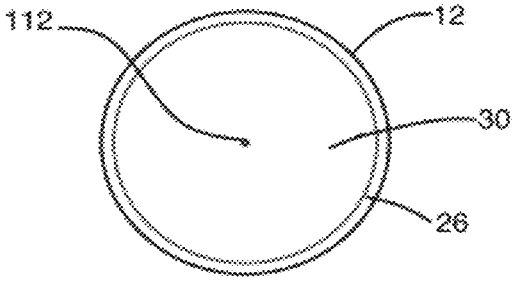
FIG. 13 is a bottom view of the housing of FIG. 4.
Figure 14:
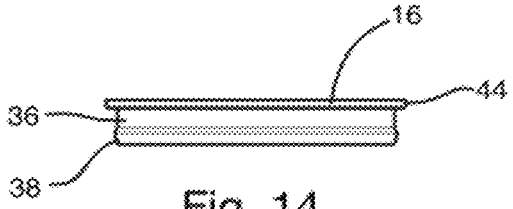
FIG. 14 is a side view of the seat of FIG. 4.
Figure 15:
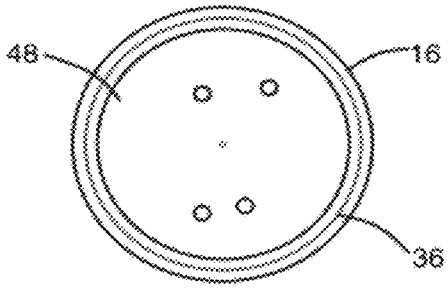
FIG. 15 is a bottom view of the seat of FIG. 4.
Figure 16:
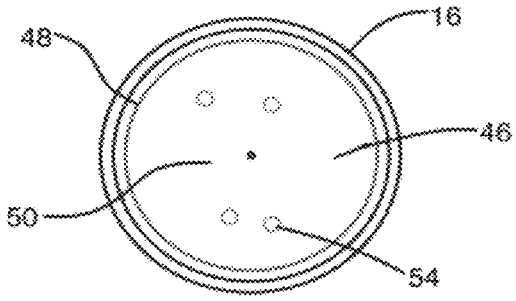
FIG. 16 is a top view of the seat of FIG. 4.

As shown in FIGS. 1 and 14-16, the seat 16 includes a lower seat wall 36 having a corresponding ridge-like ring 38 extending outwardly from the lower seat wall 36 that fits into the ridge 34 of the upper portion 20 of the housing 12. Accordingly, the seat 16 fits to the upper portion 20 of the housing 12. This ridge-ring fitting arrangement allows the seat 16 to be snapped into and out of the upper portion 20 of the housing 12. This fitting arrangement also allows the seat and housing 12 to independently rotate around a common axis 40. By example, common axis 40 runs through center points 108, 110 and 112 of top 18, seat 16 and housing 12 as shown in FIG. 4 and FIG. 13. This allows alteration of the position of the light source 14 and the direction of the light emission from the light source 14 relative to the housing 12, including the side walls 26, light-altering surfaces 28 and light-altering devices 42 thereof or therein. The seat 16 also includes an outer surface 44, shown for example in FIGS. 1 and 14, with a rough ridge pattern, for gripping and turning the set and for altering light passing through those surfaces. As shown in FIGS. 1 and 5, top 18 includes a similar pattern and any surface of the housing assembly 11 and attachment can include similar patterns.

Figure 8:
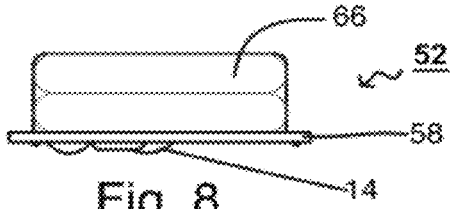
FIG. 8 is a side view of the light assembly of FIG. 4.
Figure 9A:
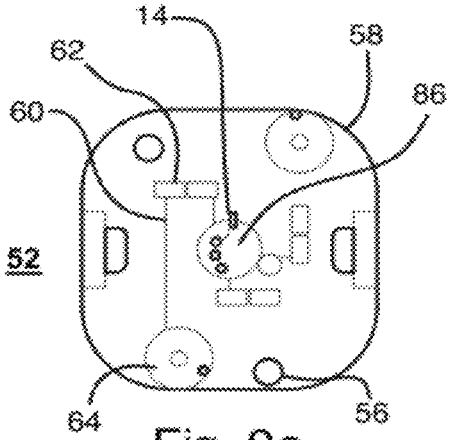
FIGS. 9A and 9B are alternative bottom views of the light assembly of FIG. 4.
Figure 9B:
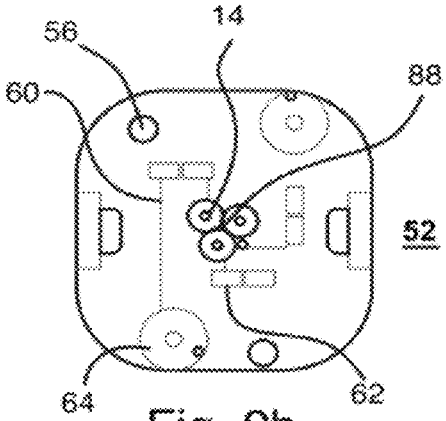
Figure 10:
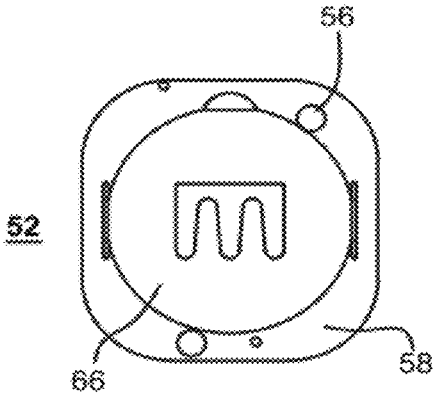
FIG. 10 is a top view of the light assembly of FIG. 4.

Continuing with FIGS. 1-4 and 14-16, and with further reference to FIGS. 8-10 for the light assembly 52 (which may comprise a pod, as in a disk or coin shaped assembly), the seat 16 further includes a seat floor 46 as well as an upper seat wall 48. The seat 16 defines a space 50 for positioning the light source 14 and light assembly 52. The light source 14 is positioned on the seat 16, preferably on the seat floor 46. Seat floor 46 includes protrusions 54 (or protuberances) by which light source 14 is fitted to the seat floor 46 via guide holes 56 in a fixture 58 for containing the light source 14. Fixture 58 preferably comprises particle board and/or printed circuit board (PCB) base material, as well as circuitry 60. As such, the fixture 58 is thin enough to be placed in small space. Yet it is also sturdy and provides a board on which to include circuitry 60 (exemplary reference shown) for the controller 62 and mount the switch 64, light source 14 and power source 66 as well as the connections there between. It is also flexible enough to accommodate the switching mechanism of the switch 64 and the fitting arrangement of the seat floor 46. Accordingly, this arrangement fixes the position of the light source 14 on the seat 16. The protrusions 54 further serve to help trigger a switch 64 connected to the light source 14 and the power source 66 and controller 62 for the light source 14. In the preferred embodiment, two protrusions 54 are used to fit through guide holes 56 to mount the fixture 58 on the seat 16, and one or two additional shorter protrusions are used to trigger switch(es) 64. The light source 14 may be positioned such that it illuminates at least a part of the lower housing portion 22, the side wall 26, light-altering devices 42 and a surface 114 supporting the illumination apparatus 10.

Accordingly, as shown in FIGS. 1-4 and 8-10, in the exemplary embodiment, the switch 64 comprises a push button switch disposed on a fixture 58 positioned in the seat floor 46 of seat 16 of the housing assembly 11. Lateral movement, such as by lateral pressure, is used to activate the switch 64. Fixture 58 is generally comprised of printed circuit board material (PCB) and is flexible to allow such activation. In the exemplary embodiment and various other embodiments, the fixture 58 further includes or has mounted or disposed on it the light source 14, power source 66, and controller 62, including circuitry 60 therefore and connections there between. These are also generally referred to as the light assembly 52. Depending on the application in which the illumination apparatus 10 will be used, the switch 64, power source 66, light source 14 and controller 62 may comprise any one of a wide range of other suitable means. Additional details and alternative embodiments are described further below in a separate section.

Returning to the structure of the housing assembly 11, including particularly the top 18, as shown for the exemplary embodiment in FIGS. 1-3 and FIGS. 5-7, the top 18 is fitted to the seat 16. Preferably, the top 18 includes a lower top wall 68 fitted to the upper seat wall 48. As shown, the light source 14, power source 66, switch 64 and controller 62 are positioned between the top 18 and seat 16 within space 50. The lower top wall 68 and upper seat wall 48 are fitted together to allow lateral movement of the top 18 relative to the seat 16 sufficient to activate the switch 64. As shown, the same ring-ridge type of fitting arrangement described above for the housing 12 and seat 16 is again used here for the top 18 and seat 16. The ring and ridge are sized to secure the top 18 and seat 16 together around the light assembly 52, while concurrently allowing enough lateral range of movement between the seat 16 and top 18 to allow the switch 64 to be activated. The top 18 and seat 16 may also independently rotate a common axis 40 to allow changes in the light effects of the apparatus. The top 18 and seat 16 may collectively comprise a pod (e.g., a disk shaped assembly), including the light assembly 52.

Figure 27:
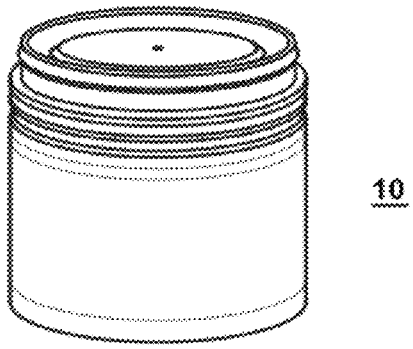
FIG. 27 is a perspective view of an embodiment of the illumination apparatus 10 shown in FIG. 4.
Figure 28:
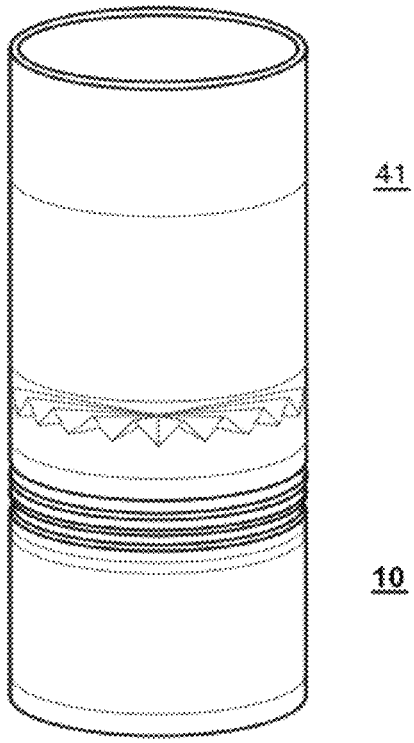
FIG. 28 is a perspective view of an embodiment of the illumination apparatus 10 and the attachment shown in FIG. 4.
Figure 29:
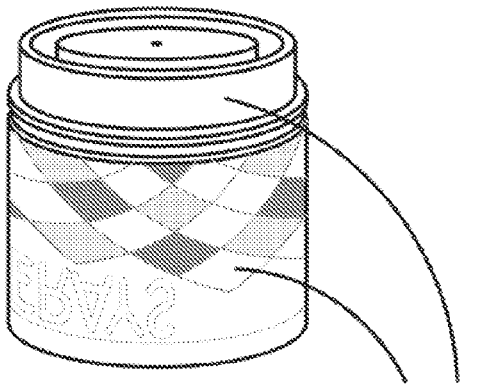
FIGS. 29, 30 and 31 are perspective views of an embodiment of the illumination apparatus as shown in FIG. 1.

Referring to FIG. 4 specifically, the exemplary embodiment of the illumination apparatus 10 is shown in perspective and exploded view. As such, the top 18, light assembly 52, seat 16 and housing 12 are shown in disassembly. Attachment 41 is shown as well. To allow ready access to the light source 14, the light-altering device 42 and/or the interior of the housing 12, the illumination apparatus 10 includes such separable components of the housing assembly 11. These components (top 18, seat 16, housing 12 (and attachment 41 as well) may be fitted together using any suitable fastening system or method (e.g., the ring-ridge fit described above, inwardly extending resilient knobs or protuberances, threaded members, resilient ribs, other interference fits, adhesives, among others). Alternatively, the housing assembly 11 can be formed as a single unit (e.g., unitary construction, such as a unitary pod) or lesser components. FIG. 27 shows the assembled illumination apparatus 10 in perspective view, and FIG. 28 shows the apparatus 10 with the attachment 41 in perspective view.

Figure 17:
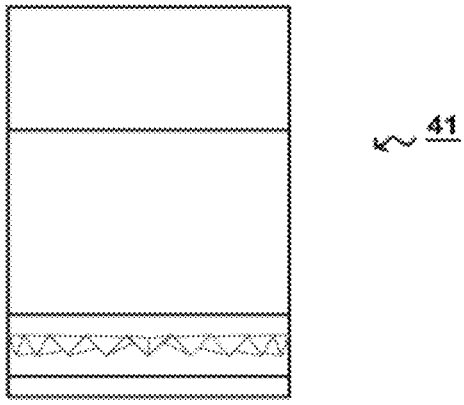
FIG. 17 is a side view of the attachment of FIG. 4.
Figure 18:
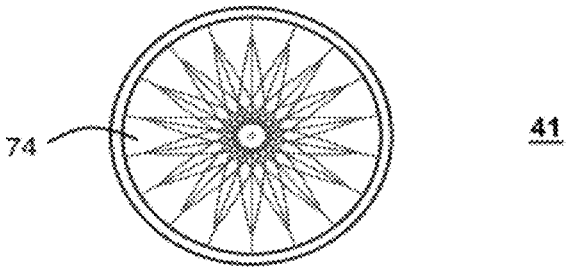
FIG. 18 is a bottom view of the attachment of FIG. 4.
Figure 19:
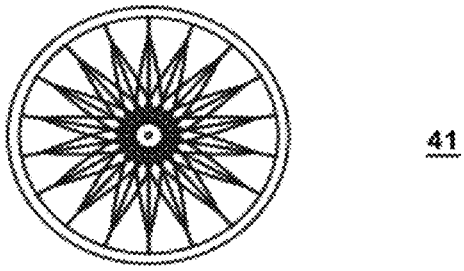
FIG. 19 is a top view of the attachment of FIG. 4.
Figure 34:
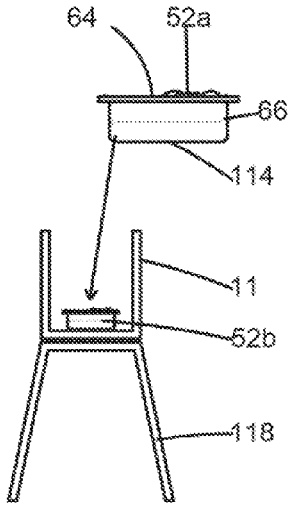
FIGS. 34, 35, 36 and 37 are side views of alternative embodiments of the illumination apparatus.
Figure 35:
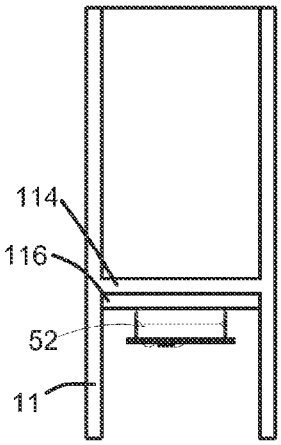
Figure 36:
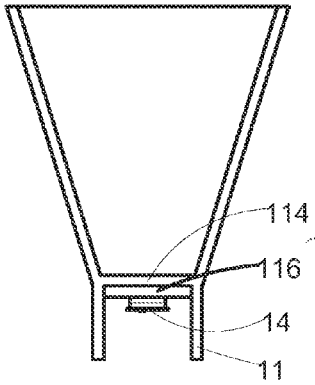
Figure 37:
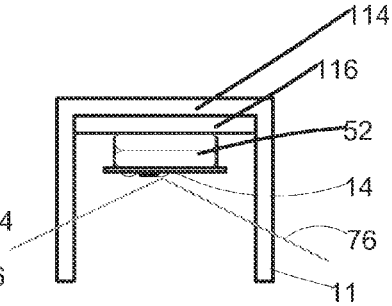

As further shown in FIG. 4, the invention may also include an attachment 41 that can be attached to the housing assembly 11 via the top 18 to provide additional features to the invention. In an exemplary embodiment, as shown in FIGS. 17-19, the attachment 41 includes a beverage receptacle 70 (or chamber), such as one resembling a shot glass. One of skill in the art will appreciate that various types of attachments 41 may be used, including attachments 41 having different sizes, shapes and dimensions of beverage and food receptacles 70 (e.g., all types of beverage glasses, bowls, plates, other dishware, etc.). Further, housing 11 and attachment 41 may be formed of unitary construction as shown in FIGS. 35 and 36. Alternatively, attachment 41 may form a stand 118 for the illumination apparatus 10 and housing 11, as shown in FIG. 34.

Figure 30:
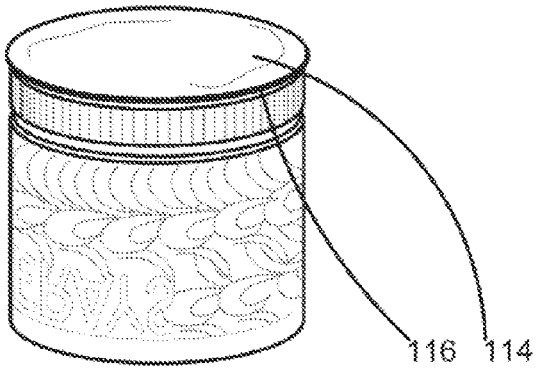
Figure 31:
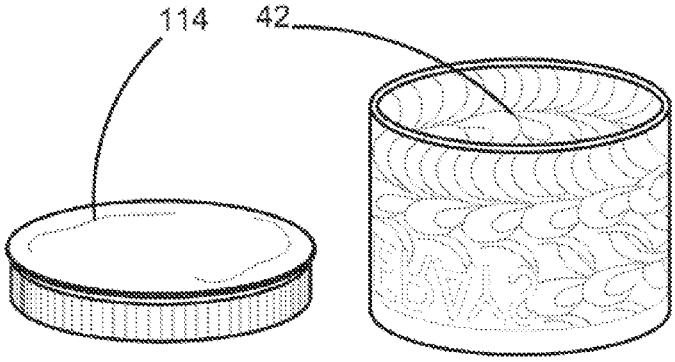
Figure 32:
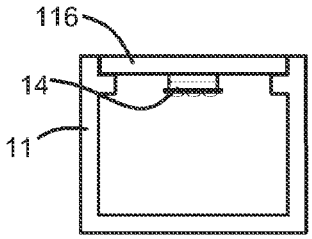
FIG. 32 is a side view of an embodiment of the illumination apparatus including a beverage receptacle attachment.
Figure 33:
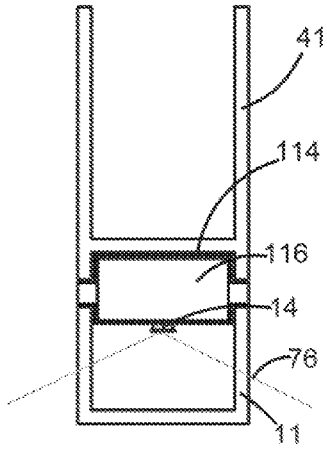
FIG. 33 is an alternative side view of an embodiment of the illumination apparatus.

The illumination apparatus 10, assembly 11, housing 12, top 18, light assembly 52 and/or attachment 41 may couple with, connect to, adhere to, join with, sit atop, sit with, cover, clasp, fasten to or otherwise attach to the other components (e.g., top 18 to attachment 41, assembly 11 to attachment 41, housing 18 to attachment 41, illumination apparatus 10 to attachment 41, light assembly 52 to any of the above) via various means, mechanisms and methods. As shown in FIG. 4, the upper top wall 72 fits within the lower attachment wall 74. This fitting is accomplished by the means described above for the fitting arrangement between the housing 12 and seat 16 and the top 18 and seat 16. As shown in FIGS. 29-37, including FIGS. 30 and 31 showing adhesive 114, and FIGS. 32, 33, 35, 36 and 37, showing padding 116, alternative embodiments include using adhesive-based materials, friction-based materials, or other interface materials (e.g., fabrics, rubbers, putties, "eda", etc.) that permits the attachment 41 to attach to/interact with other components and/or permits the light assembly 52 to connect to the housing 12, assembly 11 or attachment 41. As shown, such materials may beneficially provide padding 116 for the top 18, light assembly 52 or attachment 41. Such materials may collectively or separably form a connector. One of skill in the art will further appreciate that the any combinations of the separate components described herein may be formed into single components.

The attachment 41 and top 18 may rotate relative to the seat 16 using the fitting referenced above, including about a common axis 40. As such, the attachment adds additional shapes, surfaces, containers and movement for the illumination apparatus to provide different lighting effects.

Figure 20:
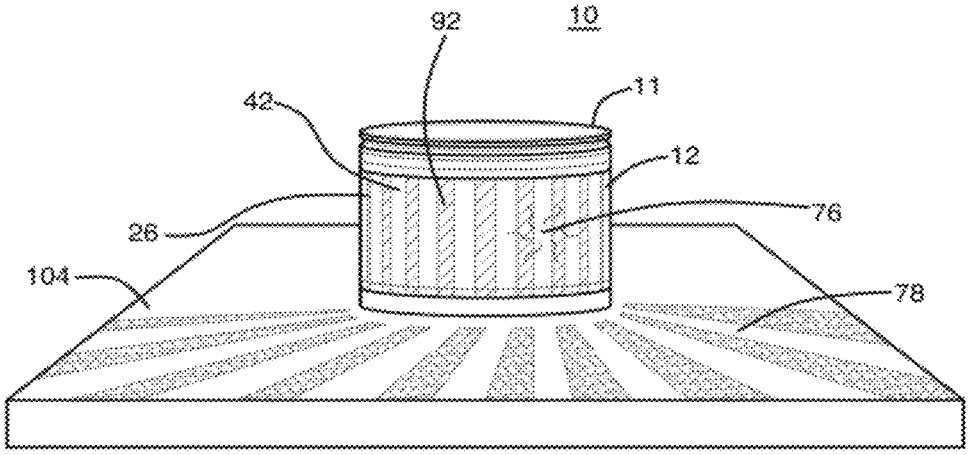
FIG. 20 is a side view of the illumination apparatus shown in FIG. 1 including a light-altering device adjacent the side wall of the housing.
Figure 21:
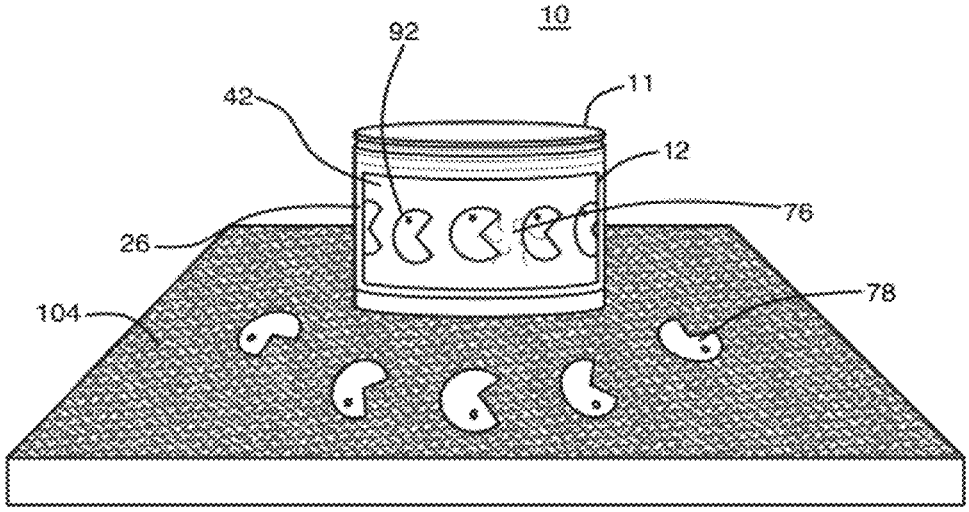
FIG. 21 is a side view of the illumination apparatus shown in FIG. 1 including an alternative light-altering device to that of FIG. 20.

As also shown in the exemplary embodiment in FIGS. 1, 4, 20 and 21, the invention also includes a light-altering device 42. For example, the light-altering device 42 may comprise a material placed in the chamber 24 adjacent the side wall 26. The material may constitute thin film-like material (e.g., acetate, etc.) having different patterns (e.g., shapes and colors), and varying translucence (e.g., the property of allowing light to pass through diffusely) and/or transparency. Such material may have light altering properties such that light changes color or other properties upon transmitting through the material. That material can be positioned in the chamber 24 adjacent the side wall 26, so that light emitted from the light source 14 can project various light patterns based on the material comprising the light-altering device 42, including the patterns thereon. For example, as shown in FIGS. 20 and 21, the light-altering device 42 alters the light emitted from the light source 14 such that the housing assembly 11 is illuminated with altered housing light 76. The altered light source 14 is directed downward through at least partly transparent or translucent housing side walls 26, thus providing the surface 114 and surrounding area in which the illumination apparatus 10 is being used with various light patterns and effects via altered housing passing light 78.

Alternatively, the light-altering device 42 may comprise a cover within the housing 12 approximate the light source 14. The light-altering device 42 may also or alternatively comprise part of the side wall 26 itself (e.g., etching, facets 80 or other patterns or variations in the material or surface of the side wall 26 of the housing 12), which can alter the light emitted by the light source 14 (e.g., altered housing light 76, altered housing passing light 78). The light-altering device 42 and the housing 12 may also be integrally formed as a single component. For example, the light-altering device may comprise an internal faceted surface of the housing 12. Additional details and alternative embodiments are described further below in a separate section.

One of skill in the art will appreciate that the features of the light-alternating device 42 described herein may be incorporated into other components described herein to achieve similar or the same results as the light-alternating device 42.

One of skill in the art will further appreciate that dividers (e.g., pie slicers) or other features that separate may be used to separate or filter different light sources. For example, a light source can be separated by color (e.g., a divider separating LEDs of different colors).

Figure 11:
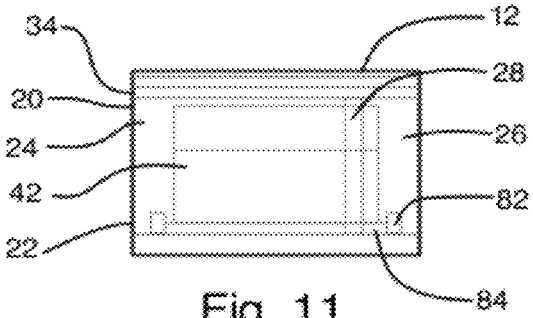
FIG. 11 is a side view of the housing of FIG. 4.
Figure 12:
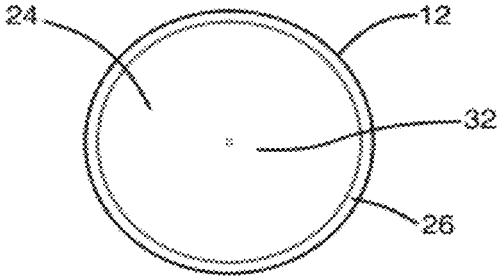
FIG. 12 is a top view of the housing of FIG. 4.

As shown in FIG. 11, the illumination apparatus 10 may also include a motion system 82 incorporated with or in communication with the controller 62, such as a turntable 84 including any necessary motor(s), to rotate or otherwise move the illumination apparatus 10, the light source 14, light-altering device(s) 42, housing 12, attachment 41, and/or other component. For example, a turntable 84 may be included at the bottom of the housing 12 to rotate the apparatus. Alternatively, a turntable may be fitted to the fixture 58 for the light source 14 to rotate the light source 14.

As another alternative, the light-altering device 42 may be positioned on a turntable 84 at a substantially central or circumventing location relative to the housing 12. In such embodiment, turntable 84 may have a transparent support surface for supporting the light-altering device 42 and be coupled to a motor that when energized rotates the turntable 84 and the light-altering device 42 thereon. Alternatively, the motion system 82 could instead be used to rotate the light source 14 relative to the light-altering device 42. By combining the movement of the turntable 84 with variations of the light source 14 (e.g., different colors, timing patterns) and light-altering device 42 (e.g., different colors, translucence, patterns) various alternative lighting effects are provided.

Motion and lighting in relation to any component may be accomplished using various techniques. For example, a particular sequence of motion and/or lighting may be programmed into the controller 62 or a suitable processor of the motion system 82, Commands that control motion and light may be based on programmed instructions, sensor-based input (e.g., input from users or from any attachment 41), or other methods.

Power Source 66

The power source 66 contemplates any suitable means of providing energy to the light source 14 including, but not limited to, renewable batteries, rechargeable batteries, disposable batteries, and other suitable power sources that may be either external or internal to the illumination apparatus 10. It may also include an AC adapter port to allow the illumination apparatus 10 to receive power through an electrical cord connected with a standard wall outlet. If rechargeable, the power source may be rechargeable by solar, magnetic, electrical, and chemical means, and the like or any combination thereof. The power source 66 may include a solar cell disposed on the housing assembly 11, including for example the top 18, side wall 16 or under transparent surfaces thereof, although other suitable means of providing energy to the light sources 14 and the motion system 82 may be employed. Accordingly, the power source mechanism should not be limited to the power source mechanisms described and shown herein.

Light Source 14, Switch 64, Controller 62

The light source 14 in the exemplary embodiment 10 comprises a plurality of variously colored raw dies (e.g., wire, fiber, optic or other light lead line components also incorporated into light-emitting diodes) positioned on the fixture 58 within thin drops of silicon, resin or similar material, as shown in FIGS. 8-10. By further explanation, this arrangement uses surface mount technology (SMT). SMT is a method for constructing electronic circuits in which the components (e.g., Surface Mounted Components) are mounted directly onto the surface of printed circuit boards (including fixture 58). An SMT component is usually smaller than its through-hole counterpart because it has either smaller leads or no leads at all. It may have short pins or leads of various styles, flat contacts, a matrix of solder balls (BGAs), and/or terminations on the body of the component. In the preferred embodiment, circuitry for controller 62 is on the surface of fixture 58 as illustrated in FIG. 9A. The light source 14 is mounted on the surface of fixture 58 within a drop of resin material 86 as referred to above. The light source 14 may be mounted within or under a unitary drop of resin or piece of silicon 86 (FIG. 9A). As shown, red (R), green (G) and blue (B) raw dies are included within a unitary drop or piece. Alternatively, as shown in FIG. 9B, a red (R), green (G) and blue (B) raw die is each included within or under a separate drop of resin or separate piece of silicon 88. That is, the R raw die is under one resin location, the G die is under a second resin location and the B die is under a third location. The latter embodiment provides advantages. Since each light has its own separate surface mounted location and mounting material, the light emitted is more distinct than when all three lights are included in one drop of resin or silicon or other mounting material. Further, the lights make better cross references to each other when multiple light sources 14 are on and multiple light colors are emitted. That is, the lights blend together according to the light emitted. Whereas, when the RGB raw dies are included within one drop of resin, the lights blend within the resin and may not be as distinct or well blended.

Alternatively, any suitable light source 14 may be employed including but not limited to light emitting diodes (LEDs), fiber optics, halogen, incandescent, laser, fluorescent, magnetic, and the like.

Figure 25:
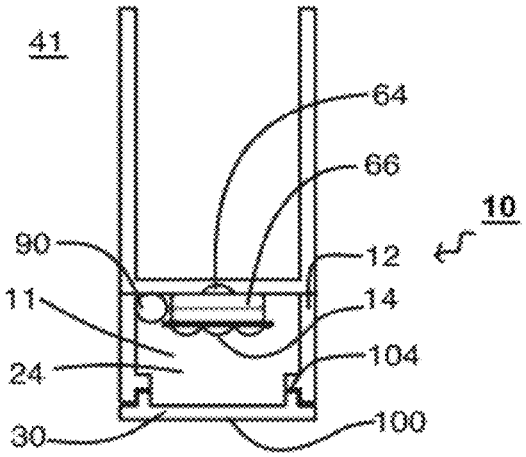
FIG. 25 is a side view of an alternative embodiment of the present invention.

In various embodiments of the invention, an illumination apparatus 10 can further include an optional light source 90 for providing normal lighting conditions (see FIG. 25). Optional light source 90 may comprise an incandescent light. It may further be on or within the housing 12, or within or partially within the housing 12 or within or adjacent the light-altering device 42 or a cavity formed thereby. The light-altering device 42 itself may be disposed substantially around the optional light source 90.

The operation of the light source 14 and the motion system 82 (i.e., motor and turntable 84, see FIG. 11) are controlled by a controller 62 in accordance with user input. As shown in FIGS. 8-10, in one embodiment, the controller 62 includes a circuitry 60/circuit board assembly (integrated circuitry board mounted on a circuit board also comprising fixture 58) and a switch 64.

In general, the switch 64 allows the user to select from among various display modes for the light source 14. Such display modes may include an off mode, a mode during which the raw dies or light-emitting diodes blink (or strobe) in a predetermined sequence. By further example, but without limitation, predetermined controller 62 settings or circuits activated by the switch 64 result in a series of lighting arrangements and light effects:

| | Action | Light Colors | Light Duration |
|---|---|---|---|
| 1. | On | Red | Constant |
| 2. | Off | No | No |
| 3. | On | Green | Constant |
| 4. | Off | No | No |
| 5. | On | Blue | Constant |
| 6. | Off | No | No |
| 7. | On | Red & green | Constant |
| 8. | Off | No | No |
| 9. | On | Blue & green | Constant |
| 10. | Off | No | No |
| 11. | On | Red & Blue | Constant |
| 12. | Off | No | No |
| 13. | On | Red & Blue & Green | Constant |
| 14. | Off | No | No |
| 15. | On | Red & Blue & Green | |
| 16. | Off | No | No |
| 17. | On | Red & Blue & Green | Strobing |
| 18. | Off | No | No |
| 19. | On | Red | Strobing |
| 20. | And so on | . . . | . . . |

As shown, this exemplary lighting arrangement could be applied to the SMT lighting arrangements described above, including where either the RGB lights are included within or under a single location of resin (FIG. 9A) or each are included under or within separate mounting locations (FIG. 9B). This light arrangement could also be applied to the strobing (or blinking) of light sources 14 to provide persistence of vision effects as described in more detail below. Accordingly, the light sources do not necessarily move (by turntable 84 as discussed below), but strobe or blink rapidly, and, in combination with movement of the light altering devices 42 (e.g., films, facets, other items) the projected light moves.

Accordingly, the switch 64 may allow the user to cycle through such various display modes or select a particular color for the light by successively squeezing the illumination apparatus to activate the switch 64. In addition, in alternative embodiments, such display modes may include modes during which the light sources 14 (e.g., raw dies, LEDs) pulsate to sounds. The sounds may be produced by the apparatus 10 itself (e.g., via a speaker built-in to the apparatus 10) or a source external to the apparatus 10 (e.g., ambient sounds). Such display modes may also include modes for movement based on the motion system 82, where user to select from a plurality of predetermined rotational speeds for the turntable 84 via the switch 64 or other means for selection incorporated with the controller 62.

As such, in various embodiments of the invention, an illumination apparatus 10 may include a controller 62 for controlling operation of the light source 14 in accordance with user input to provide such features as blinking, strobing and/or color changes. As discussed in more detail below, blinking or strobing may be used to provide persistence of vision effects in lighting effects of the illumination apparatus 10 (see e.g., FIG. 21). The switch 64 may, for example, allow the user to select from among various display modes for the light sources 14, in which each of the light sources 14 simultaneously emit steady or non-flashing light, a mode in which the light sources 14 emit light intermittently, a mode in which the various light sources 14 illuminate or blink at different times in accordance with a predetermined sequence or order, a mode in which the light sources 14 emit light that phases between or blends colors, a mode in which the light sources 14 emit light randomly, a mode in which the light sources 14 pulsate to sounds, a mode which activates motion, and/or a mode combining one or more of the foregoing.

The switch 64 and controller 62 may be any suitable devices. For example, the switch 64 may be provided on a cord extending from the housing assembly 11. As yet another example, an illumination apparatus 10 can include electrical terminals for switchably connecting the light source 14 to the power source 66. For example, the electrical terminals can be located such that a user's hand upon grasping the item completes the circuit for power delivery to the light source 14 from the power source 66. Or for example, the controller 62 may be configured for use with an infrared remote control. The controller 62 can also include a plurality of switches 64 each of which can be used to control the operation of an individual light source 14 or group of light sources 14. Additionally, the switch 64 may also allow the user to dim or brighten the intensity of the light source 14, for example, by holding down the switch 64 with continuously applied pressure.

Light-Altering Device 42

The light-altering device 42 will now be described in more detail. The light-altering device 42 is positioned relative to the housing 12 and the light source 14 for receiving and altering light from the light source 14 such that the altered light source 14 has variant lighting effects (e.g., via altered housing light 76, altered housing passing light 78). During operation, the light-altering device 42 refracts, reflects, diffracts, and/or disperses the light source 14 such that the altered light source 14 illuminates the portion(s) of the housing 12 and/or the support surface 114 with mood-enhancing light patterns and effects. Alternatively, or additionally, the light-altering device 42 may be positioned relative to the housing 12 and the light source 14 such that the altered light source 14 illuminates at least a portion of a surface 114 supporting the illumination apparatus 10, such as a wall, ceiling, floor, tabletop, walkway, clothing, a surface of a mobile platform, etc. See e.g., FIGS. 20, 21.

A wide range of materials can be used for any one of the light-altering devices 42 including polished acrylic materials, glasses, plastics, crystals, gemstones, transparent materials, translucent materials, mirrors and other reflective materials, combinations thereof, among others. In several embodiments (see, e.g., FIG. 24), the light-altering devices include facets 80. In further embodiments, a light-altering device 42 can be an integral portion of the housing 12 or housing assembly 11 such that the light-altering device 42 and the housing 12 or housing assembly 11 are monolithically formed as a single component. For example, one embodiment includes a housing 12 having one or more internal faceted surfaces as a light-altering device 42.

The light-altering device 42 can have a variety of shapes. In the illustrated embodiment, the light-altering device 42 is shaped in a substantially similar manner as the housing 12 and housing assembly 11 (e.g., cylindrically-shaped as in FIGS. 1-3 and 20-21). In other embodiments, the light-altering device 42 may have a substantially spherical, pyramidal, prismatic, alphanumeric, or other shape depending on the application for which the illumination apparatus 10 will be used. As stated above, various shapes and dimensions are contemplated herein.

As further shown in FIGS. 20-21, as part of the light-altering device 42, the illumination apparatus 10 may further include one or more indicia 92 positioned to receive the light emitted directly from the light source 14 and/or to receive the altered housing light 76 from another part of the light-altering device 42 or an additional light-altering device 42. The indicia 92 may be at least partially opaque, translucent, or a combination thereof such that the light source 14 and/or altered housing light 76 produces a silhouette of the indicia 92 that is displayed to a user. The indicia 92 may include any of a wide range of symbols, characters, shapes, words, logos, other alphanumeric characters and combinations thereof, etc. Depending on the particular placement of the indicia 92, the illumination apparatus 10 may display the silhouette within the housing 12 and/or on a surface external to the housing 12, such as the support surface 114 (or a wall surface and various other surrounding surfaces). Various embodiments include a light-altering devices 42 (e.g., acetate material) having indicia 92 configured to receive light emitted from the light source 14 such that the light source 14 produces a representation of the indicia 92 onto a surface external to and adjacent the illumination apparatus 10. During operation, the light-altering device 42 refracts, reflects, diffracts, and/or disperses the light source 14 such that the altered light source 14 illuminates the surface 114 supporting the apparatus 10 with various light patterns and effects.

In alternative embodiments, an illumination apparatus 10 includes light sources 14 (e.g., raw dies, LEDs) that are positioned proximate the lower housing surface 30 or a surface in the upper portion 20 of the housing 12 or housing assembly 11 (e.g., proximate the perimeter of the housing assembly 11). The raw dies or LEDs are positioned to direct light source 14 at a generally downward or upward angle towards indicia 92 provided (e.g., etched, marked onto, etc.) onto a light-altering device 42. The indicia 92 can be distorted such that the indicia 92 appear clear and undistorted when projected onto the support surface 114. By way of example only, the light-altering device 42 may include indicia spaced around the outer perimeter of housing 12 such that when the light sources 14 are activated, the light source 14 projects the indicia 92 onto the support surface 114 generally around but a spaced-distance away from the housing's 12 outer perimeter.

By further example, in alternative embodiments, an illumination apparatus 10 includes light source 14 (e.g., raw dies, LEDs, including multiple light sources 14) positioned either at the upper or lower portions (20 or 22) of housing 12. The light-altering device 42 comprises a mirror mounted to the opposite side of the housing 12 to the light source 14. Alternatively, the light-altering device 42 is placed at a mid-point in the chamber 24. The mirror is preferably conical, but can include other forms, such as circular disks or round balls. The light-altering device 42 constituting the mirror reflects the light emitted from the light source 14 to provide light effects. As described earlier, either the light source 14 or light-altering device 42 can also be rotated by turntable 84 to provide further light effects. A lens may be included with light source 14 to focus the emitted light on or towards the light-altering device 42 (e.g., mirror) to further alter the light effects.

By further example, FIG. 21 further illustrates an embodiment where blinking or strobing the light source 14 may be used to provide persistence of vision effects in lighting effects of the illumination apparatus 10. Persistence of vision involves an eye phenomenon by which an afterimage is thought to persist momentarily by the viewer (e.g., similar to moving film being comprised of a series of still images, also similar to a flip book constituting several successive still images that appear to move when the pages of images are flipped in rapid succession). By further example, still images projected at 8 images per second generate persistence of vision effects. As shown in FIG. 21, the light-altering device 42 includes a series of indicia 92 (e.g., images) of an object at different stages of motion. The persistence of vision movement of the images can be generated as light effects by the illumination apparatus 10 in several ways. For example, the light-altering device 42 may be rotated via the turntable 84 (e.g., a carousel like turntable 84 attached to the light-altering device 42 from above or below) at sufficient speed to provide a persistence of vision light effect of the images projected via the light-altering device 42 and based on its indicia 92. Alternatively, the light source 14 may be rotated via turntable 84 so that it emits light through each indicia 92 (e.g., image) in the light-altering device 42 in rapid succession at sufficient speed to provide a persistence of vision light effect. As another alternative, multiple light sources 14 may be included along the perimeter of fixture 58 or the perimeter of the housing assembly 11. The latter arrangement may comprise mounting multiple light sources 14 in the perimeter of the upper portion 20 or lower portion 22 of the housing 12, the outer wall of the seat 16, or the outer wall of the top 18. In any of these arrangements, the multiple light sources 14 may emit light in rotating fashion through the images or other indicia 92 of the light-altering device 42 (e.g., one emits light for a short duration, followed by the proximate light source 14 and so on around the perimeter of the housing assembly 11). The rotation of emitted lights is at sufficient speed to provide a persistence of vision light effect. As explained in more detail herein, the controller 62 can include preprogrammed sequences for these effects. Or, the multiple light sources 14 may emit light, while the light-altering device 42 rotates via the turntable at sufficient speed to provide a persistence of vision light effect based on each of the multiple light sources 14.

Light patterns that illuminate game boards, art, pictures or other entertainment (e.g., video) are also contemplated. Such games may include tic tac toe, roulette (e.g., where the motion of the light source could randomly stop at an orientation respective a user), or even games using dice. Such game boards may comprise table tops, boards, cocktail napkins or printed sheets of paper. Another attachment may be used to determine the light pattern depending on the game. Further, the game board could be created by light projection onto the a surface upon which the housing 12 rests, and it could move around an object like a playing piece, dice, coin, etc. Alternatively, two light sources 14 could be used, one for the game and the other to add a brighter light to certain area or use a color to pick the winning spot.

Similarly, various three-dimensional (3D) pieces could be used (e.g., horse, person). For example, the attachment 41 or light altering device 42 could constitute a wedding cake or wedding cake stand connected on top of the housing 12, adjacent the housing 12 or within the housing 12, with the wedding couple rotating or otherwise moving (e.g., dancing). The illumination apparatus 10 could further or alternatively include a 3D stroboscopic zoetrope as the light source 14 and light altering device 42. Further, full color figures (e.g., via 3D printers) could be used in conjunction with the strobe (or other light source 14). If the figures are hollow and translucent, the light source 14 could be put inside. The figures could be further used on or in connection with a receptacle (e.g., glass, ice bucket, coaster, center piece), coaster or center piece, for example.

Additional Embodiments

Figure 22:
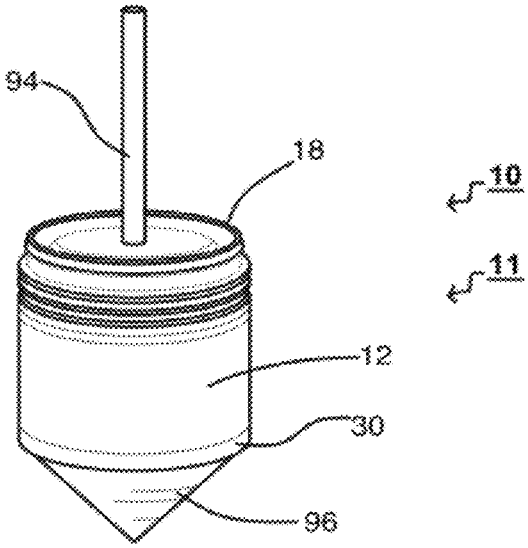
FIG. 22 is a side view of an alternative embodiment of the present invention.
Figure 23:
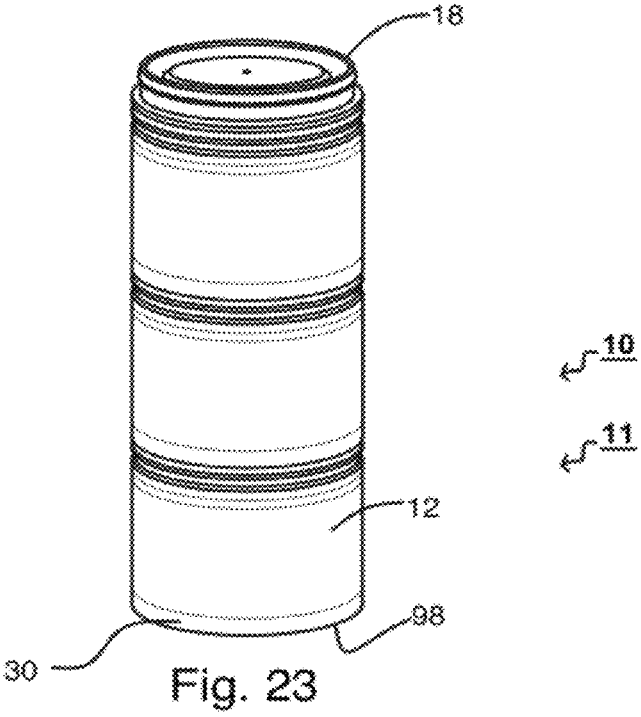
FIG. 23 is a side view of a plurality of the illumination apparatus of FIG. 1 stacked together.

FIGS. 22 and 23 illustrate various illumination apparatus 10 according to additional embodiments of the invention. As shown, each illumination apparatus includes a housing 12 at least one light source 14, at least one power source 14, a switch 64, a controller 62 and can include at least one light-altering device 42. As shown in FIG. 22, the housing assembly 11 may include appendages 94 and 96 extending from the top 18 and housing lower surface 30 of the housing assembly 11 to provide further visual effects. Here, the appendage 94 on the top 18 of the housing assembly 11 provides a handle for holding, turning over and spinning the housing assembly 11 (e.g., like a top). The appendage 96 on the housing lower surface 30 of the housing assembly 11 provides a spinning point for the illumination apparatus 10 when used as a spinning top. This embodiment provides additional lighting effects via the rotation of the housing assembly 11 itself as a spinning top and via the movement via the appendages 94 and 96. FIG. 23 illustrates an additional embodiment whereby a series of housing assemblies 11 are stacked on top of each other. The housing lower surface 30 of the housing 12 of the housing assembly 11, including particularly the lower portion 22 of housing 12 includes a lower wall 98 similar to attachment 41 to allow connection to the top 18 of another housing assembly 11. Accordingly, multiple illumination apparatus 10 can be fixed together in stacked arrangement. This provides an embodiment for combining the light effects from each illumination apparatus 10 into a concurrent and/or unitary light effect.

Figure 24:
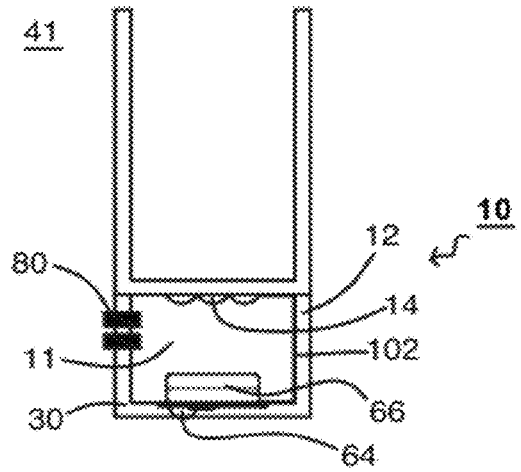
FIG. 24 is a side view of an alternative embodiment of the present invention.
Figure 26:
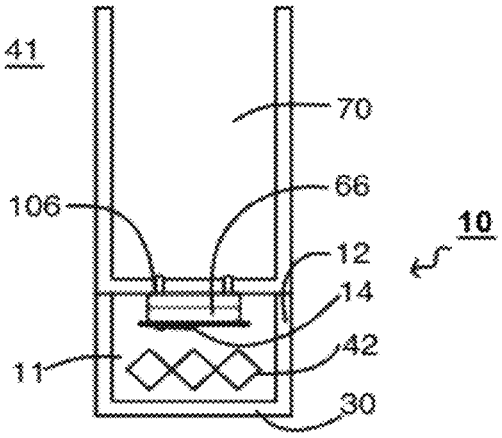
FIG. 26 is a side view of an alternative embodiment of the present invention.

FIGS. 24-26 illustrate various illumination apparatus 10 according to additional embodiments of the invention. As shown, each illumination apparatus 10 includes a housing 12 at least one light source 14, at least one power source 14, a switch 64, a controller 62 and can include at least one light-altering device 42. FIG. 24 illustrates an embodiment where the power source 66 and switch 64 are positioned on a lower housing surface 30 of the housing 12. The switch 64 is accessible via the bottom of the housing 12. The power source 66 is connected to the light source 14 via a wire 102 or other suitable conductor run partially along or within a side wall 26 of the housing 12. FIG. 25 illustrates an alternative embodiment wherein the housing lower surface 30 of the housing 12 comprises a removable cover 100. The cover 100 fits to the remainder of the housing 12 through suitable fitting arrangements as described above. The cover 100 further includes lips, grooves or other suitable attachment means 104 to hold light-altering devices 42, such as acetate strips with indicia 92. FIG. 26 shows another alternative embodiment including water probes 106 extending from the power source 66 and constituting switching means 64. The water probes 106 are water or other fluid activated, therefore the switch 64 is activated by the presence or absence of water or other fluid (e.g., in the attachment 41 as shown). The embodiment of FIG. 26 also includes printing of indicia 92 on the outer surface of housing 12 for light-altering devices 42.

In another embodiment of the invention, the illumination apparatus 10 may comprise in whole or in part pewter glassware. For example, the lower portion 22 of the housing 12 may comprise pewter glassware providing a pattern of openings through the pewter through with light may pass. The openings may be provided around the perimeter of the housing 12 so that light shines through the openings all around the pewter glassware.

In another embodiment of the invention, the illumination apparatus 10 may include multiple light sources 14, including one in the form of an electronic candle light (e.g., a LED that emits a soft, diffuse candle emulating light) and additional more distinct, powerful and sharp light sources 14 (e.g., raw dies, LED's, etc.). As such a candle tea light may be emulated by the illumination apparatus 10. In addition, the range of light effects of the illumination apparatus 10 described for the various embodiments herein may be combined via additional light sources 14.

In various embodiments of the invention, the housing assembly 11 or housing 12 of an illumination apparatus 10 can be configured such that they are substantially fluid-tight or waterproof for underwater use. For example, rubber or plastic washers may be incorporated in the joints of the fitting arrangements described above or the apparatus 10 may have a unitary construction. In such embodiments, a waterproof illumination apparatus 10 may be positioned within (e.g., thrown into the water, attached to the pool bottom, side surface, or ladder, etc.) in order to provide a pleasing light pattern or effect. In one implementation, a waterproof illumination apparatus 10 is positioned and attached to an existing lighting fixture in the swimming pool. In another implementation, one or more waterproof illumination apparatus 10 can be used for recreational purposes in which the waterproof illumination apparatus 10 are thrown into the pool for later retrieval by a swimmer. In one embodiment, a waterproof illumination apparatus 10 is negatively buoyant such that the apparatus sinks. In another embodiment, a waterproof illumination apparatus 10 is positively buoyant such that the apparatus floats. In yet another embodiment, a waterproof illumination 10 apparatus has buoyancy such that the apparatus is suspended between a top surface of the water and the bottom of the pool.

Alternative Placements of Illumination Apparatus

Depending on the particular application in which the illumination apparatus 10 is to be used, the illumination apparatus 10 may be configured for a variety of placement applications and options. For example, illumination apparatus 10 may be used upon a horizontal support surface, such as a tabletop or desktop.

In the exemplary embodiment shown in FIGS. 1 through 3, the housing lower surface 30 positioned opposite the support surface 114 is transparent, whereas the housing side wall 26 is also at least partly transparent to allow light to pass through or alternatively translucent or frosted to diffuse or soften the altered light source 14 passing through a light-altering surface 28 of the side wall 26. Alternatively, the illumination apparatus 10 can be configured to be mounted on a wall, retrofitted to (e.g., mounted and electrically connected to) an existing wall or ceiling junction box, or attached to a surface of a mobile platform, such as an automobile.

Further, in various embodiments illustrated in FIGS. 1 through 4, 27 and 28, the illumination apparatus 10 can be configured for use as a portable accessory item. In addition, the illumination apparatus 10 can also include one or more user attachment devices (e.g., magnets, adhesives, clips, pins, other suitable attachment devices, etc.) for attaching the illumination apparatus 10 to a user, for example to allow the illumination apparatus 10 to be used as jewelry, a hair ornament, an illuminating sticker, among other accessory items. Alternatively, the illumination apparatus 10 may also be attached to an automobile hood or other mobile platform surface, for example, to illuminate an automobile emblem or logo.

In addition, the illumination apparatus 10 may be inserted in openings of such devices or accessories may be inserted in openings or cavities of the illumination apparatus (e.g., opening 32, chamber 24). The housing 12 or housing assembly 11 and the openings in which the illumination apparatus 10 are inserted (or which may be inserted in the illumination apparatus 10) need not be the same shape. Further, the size and shape of the housing 12 or housing assembly 11 and such opening can vary depending, for example, on the particular application and size and shape of the component (or portion thereof) that the apparatus 10 will ultimately be positioned within or that the opening will be positioned within the apparatus 10. By way of example only, an illumination apparatus 10 of the present invention can be used with recessed ceiling lighting fixtures or cans, doorknobs, ceiling fans, appliance knobs, cabinetry handles and knobs, smoke detectors, underwater swimming pool lights and/or filters, faceplates (e.g., burglar alarm system punch-code faceplates, wall outlets, light switches, etc.) cabinet doors, speaker panels, heating and air conditioning vents, clocks, furniture, tableware, plates, dishes, clothing, furniture, jewelry, among other suitable uses. By further example, the illumination apparatus 10 may comprise or be inserted into a compartment of a commercial product or accessory, such as the base of glassware or dishware, the base of desktop ornament, a fixture or a component of furniture or the heel of a shoe. For example, the illumination apparatus 10 could comprise the heel of a shoe or be inserted into a heel of a shoe having transparent or translucent side and/or bottom walls through the light effects of the illumination apparatus 10 are visible. As another example, the illumination apparatus 10 may be placed within glassware or dishware, such as pewter ware. By further example, the lower portion 22 of the housing 12 may be fitted within pewter glassware, wherein the pewter glassware includes a series of holes or other openings in a pattern around its perimeter. Light emitted from the illumination apparatus 10 passes through the openings of the pewter glassware, so that the light effects are modified by the pewter hole pattern.

The description of the invention is merely exemplary in nature and is in no way intended to limit the invention, its application, or uses. Thus, variations that do not depart from the substance of the invention are intended to be within the scope of the invention. Such variations are not to be regarded as a departure from the spirit and scope of the invention.

I claim:

1. An illumination apparatus comprising:

a housing defining a housing chamber;

at least one light-altering surface;

at least one light source for emitting light through the at least one light-altering surface;

an attachment wherein the attachment defines an attachment chamber disposed to receive a beverage;

a power source, a switch and a controller connected to the at least one light source;

a motor, wherein the controller causes the motor to rotate the at least one light alternating surface or the at least one light source about a central axis.

2. The illumination apparatus of claim 1, further comprising a seat between the housing and the attachment, said seat permitting independent rotation of the housing with respect to the attachment.

3. The illumination apparatus of claim 1, wherein the attachment sits atop the seat without connecting to the seat.

4. The illumination apparatus of claim 1, wherein the housing include the light-altering surface.

5. An illumination apparatus, comprising:

a housing defining a housing chamber and including at least one housing side wall including at least one light-altering feature;

a seat fitted to the housing to allow independent rotation of the housing and seat about a common axis, wherein the seat includes a seat floor with protrusions and upper and lower seat walls, the lower seat wall fitted to the upper housing portion;

at least one light source for emitting light and positioned on the seat such that the light source illuminates at least one part of the housing;

a power source, a switch and a controller connected to the light source;

a top fitted to the seat with the light source, power source, controller and switch there between; and at least one light-altering device comprising partially translucent material placed in the housing chamber.

6. The illumination apparatus of claim 5, wherein the at least one light source is positioned on the protrusions of the seat floor such that the light source further illuminates at least one section of the side wall and a portion of a surface supporting the illumination apparatus.

7. The illumination apparatus of claim 5, wherein the top includes a lower top wall fitted to the upper seat wall to allow lateral movement of the top relative to the seat sufficient to activate the switch and allow independent rotation of the top and seat about the common axis.

8. The illumination apparatus of claim 5, further comprising an attachment including an upper attachment portion defining a beverage receptacle and a lower attachment wall, the top fitted to the lower attachment wall.

9. An illumination apparatus, comprising:

a housing including walls and defining a housing chamber, wherein the housing further comprises a receptacle chamber;

at least one light-altering surface along a wall of the housing;

at least one light source for emitting light through the at least one light-altering surface, wherein the emitting light is projected onto a surface on which the housing is placed;

a light assembly comprising a power source, a switch and a controller connected to the at least one light source; and a connector on a surface of the light assembly for connecting the light assembly to another surface, wherein the connector comprises an adhesive and the light assembly connects to and disconnects from a surface of the housing via the adhesive, and wherein the connector further comprises a pad.

* * * * *